US005668457A

United States Patent [19]

Motamed

[11] Patent Number: 5,668,457

[45] Date of Patent: Sep. 16, 1997

[54] VARIABLE-FREQUENCY AC INDUCTION MOTOR CONTROLLER

[75] Inventor: Farzin Motamed, Binghamton, N.Y.

[73] Assignee: Martin Marietta Corporation, Binghamton, N.Y.

[21] Appl. No.: 497,493

[22] Filed: Jun. 30, 1995

[51] Int. Cl.[6] ..... G05B 1/02

[52] U.S. Cl. ..... 318/606; 318/798-815; 60/325; 388/929

[58] Field of Search ..... 318/798–815, 318/606, 645, 98, 254, 138, 439; 60/325, 419, 423, 426; 388/929, 805

[56] References Cited

U.S. PATENT DOCUMENTS

| | | | |
|---|---|---|---|
| 3,753,064 | 8/1973 | Agarwal et al. | 318/800 X |
| 3,789,355 | 1/1974 | Patton | 318/801 X |
| 5,092,824 | 3/1992 | Connett | 60/325 X |
| 5,131,507 | 7/1992 | Watanaabe | 318/800 X |
| 5,436,547 | 7/1995 | Nagai et al. | 318/801 |

*Primary Examiner*—Karen Masih
*Attorney, Agent, or Firm*—W. H. Meise; P. J. Checkovich; S. A. Young

[57] ABSTRACT

A hydraulic pump (16) is driven by an induction motor (14) from a source of multiphase alternating current (10) of either fixed or variable frequency. The pressure is applied to a hydraulic load, which may vary, and change the pressure. A pressure sensor coupled to the pump produces pressure signals. The motor includes plural windings, typically three, associated with a number of poles. Each motor winding is driven by a different phase of controlled alternating current. A rectifier (46) coupled to the multiphase AC source generates direct current, which is filtered to minimize DC ripple voltage. A controllable multiphase inverter (54) is coupled to the rectifier and to the motor windings, for converting the direct voltage into multiphase alternating motor drive voltages of controllable amplitude and frequency. An error signal generator (322) is coupled to the pressure sensor and to sources of signals representing reference pressures (310) and motor speeds (320), for generating a pressure-modified speed error signal. An inverter gate driver (66, FIG. 2) is coupled to the motor speed signal generator and to the inverter, for converting the motor speed signal into alternating drive signals for the windings of the motor. The drive signals have a fundamental frequency equal to the desired motor speed multiplied by one-half the number of the poles of the motor, and an amplitude which is normalized by the ratio of the fundamental frequency to a reference frequency. The alternating drive signals at the fundamental frequency include a component at the third harmonic of the fundamental frequency.

6 Claims, 5 Drawing Sheets

VARIABLE-FREQUENCY AC INDUCTION MOTOR CONTROLLER

FIELD OF THE INVENTION

This invention relates to alternating-current induction motors, and more particularly to controllers for operating such motors with variable frequency for feedback control of load power.

BACKGROUND OF THE INVENTION

Reliability and cost considerations have caused aircraft designers to consider the use of variable-frequency electrical distribution systems. The majority of AC loads on an aircraft can accommodate various source frequencies, and therefore can operate with either fixed or variable drive frequencies. AC induction motors are very desirable for aircraft use, as they are rugged, reliable, and inexpensive. AC induction motors, however, are designed for constant volts-per-Hertz drive, for example 120 VAC at 400 Hz. When operated at frequencies other than the design frequency, such motors convert power inefficiently, and draw increased drive current. Known systems drive such AC induction motors directly from the variable-speed AC source, with the result that the inefficient power conversion reduces the useful torque, so the size of the rotor must be increased in order to maintain the power conversion. Thus, the motors must be larger and concomitantly heavier, and dissipate more heat than is desirable. Improved arrangements for operating AC induction motors from variable-speed sources are desired.

SUMMARY OF THE INVENTION

A system for driving a hydraulic pump from a source of multiphase alternating current includes a hydraulic pump with a mechanical drive arrangement, which produces hydraulic pressure for application to a hydraulic load which may vary. A pressure sensor is coupled to the hydraulic pump, for producing pressure signals representative of the hydraulic pressure. A multiphase alternating-current induction motor is mechanically coupled to the mechanical drive arrangement of the hydraulic pump for mechanical drive thereof. The motor includes at least a plurality of windings, typically three, associated with a predetermined number of poles. Each winding of the motor is driven by a different phase of the controlled alternating current, for driving the pump in response to electrical power applied to motor windings. A rectifying arrangement is adapted to be coupled to the source of multiphase alternating current, for generating direct voltage. The direct voltage is filtered, as by capacitors and/or inductors. A controllable multiphase inverter is coupled to the rectifying arrangement and to the plurality of motor windings, for converting the direct voltage into multiphase alternating voltages of controllable amplitude and frequency, which are applied to the windings of the motor. A pressure error signal generator is coupled to the pressure sensor and to a source of signals representing a reference pressure, for generating a difference signal indicative of the pressure error. A motor drive speed signal generator is coupled to the error signal generator, for converting the pressure error signal into signals representative of the desired motor speed, which corresponds to the most efficient motor speed for the current load condition. An inverter gate driver is coupled to the motor speed signal generator and to the inverter, for converting the motor speed signal into alternating motor drive signals for the windings of the motor. The drive signals are constructed by high-frequency switching between the positive and negative DC voltage rails of the inverter. The high-frequency switching uses a sinusoidal pulse-width modulation profile which generates alternating drive waveforms or signals with a controlled fundamental frequency and amplitude. The fundamental frequency is equal to the desired motor speed multiplied by a quantity, which quantity is equal to one-half the number of the poles of the motor. The amplitude is normalized by the ratio of the fundamental frequency to a reference frequency. The alternating drive signals include a component at the third harmonic of the fundamental frequency, which effectively allows the generation of higher amplitude AC output voltages than that which would be available from the DC bus in the absence of the third-harmonic component.

In a particular embodiment of the invention, a soft-start arrangement is included. The soft-start arrangement includes a triggering arrangement based upon the activation of an external switch which initializes the motor control velocity loop at one-tenth of the rated motor speed, and which subsequently allows the power-on-demand portion of the loop to accelerate the motor in accordance with a preprogrammed acceleration schedule.

DESCRIPTION OF THE INVENTION

Figure 1:
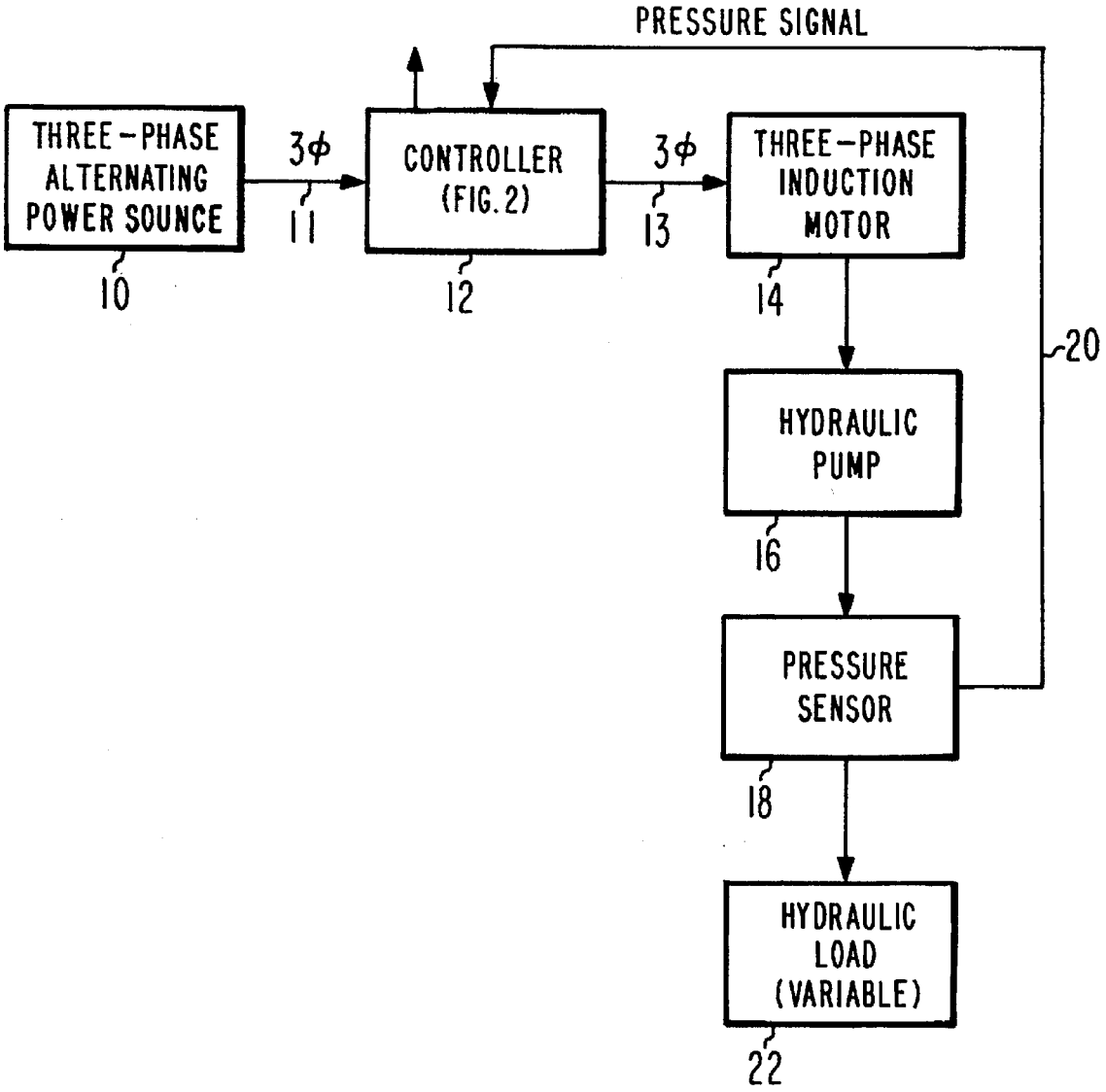
FIG. 1 is a simplified block diagram of a variable frequency AC motor driver hydraulic pump system according to the invention.

FIG. 1 is a simplified block diagram of one embodiment of the invention. In FIG. 1, a three-phase alternating voltage source, which may be of fixed or variable frequency, and which is illustrated as a block 10, provides three-phase (3Φ) voltage over paths 11 to a motor controller 12. Motor controller 12 processes the incoming power from source 10, and generates three-phase motor drive signals, at variable amplitude and frequency, as described below, which are applied over paths 13 for driving motor 14. Motor 14 is a three-phase induction motor. The induction motor 14 may be one designed for operation at a particular frequency, such as 400 Hertz (Hz.), and at some fixed amplitude, such as sinusoidal 200 $VAC_{LL}$, where the subscript "LL" refers to the line-to-line RMS voltage. A hydraulic pump 16 is coupled to motor 14 for being mechanically driven thereby. Pump 16 generates hydraulic pressure in response to motor drive. The hydraulic pressure produced by pump 16 is applied to a hydraulic load illustrated as a block 22, and the pump pressure is sensed by a pressure sensor 18. The pressure signal produced by pressure sensor 18 is applied over a feedback path 20 to motor controller 12. As described below, pump 16 is ultimately driven at a variable rotational rate or speed, so as to tend to maintain constant pump pressure for application to the hydraulic load.

Figure 2:
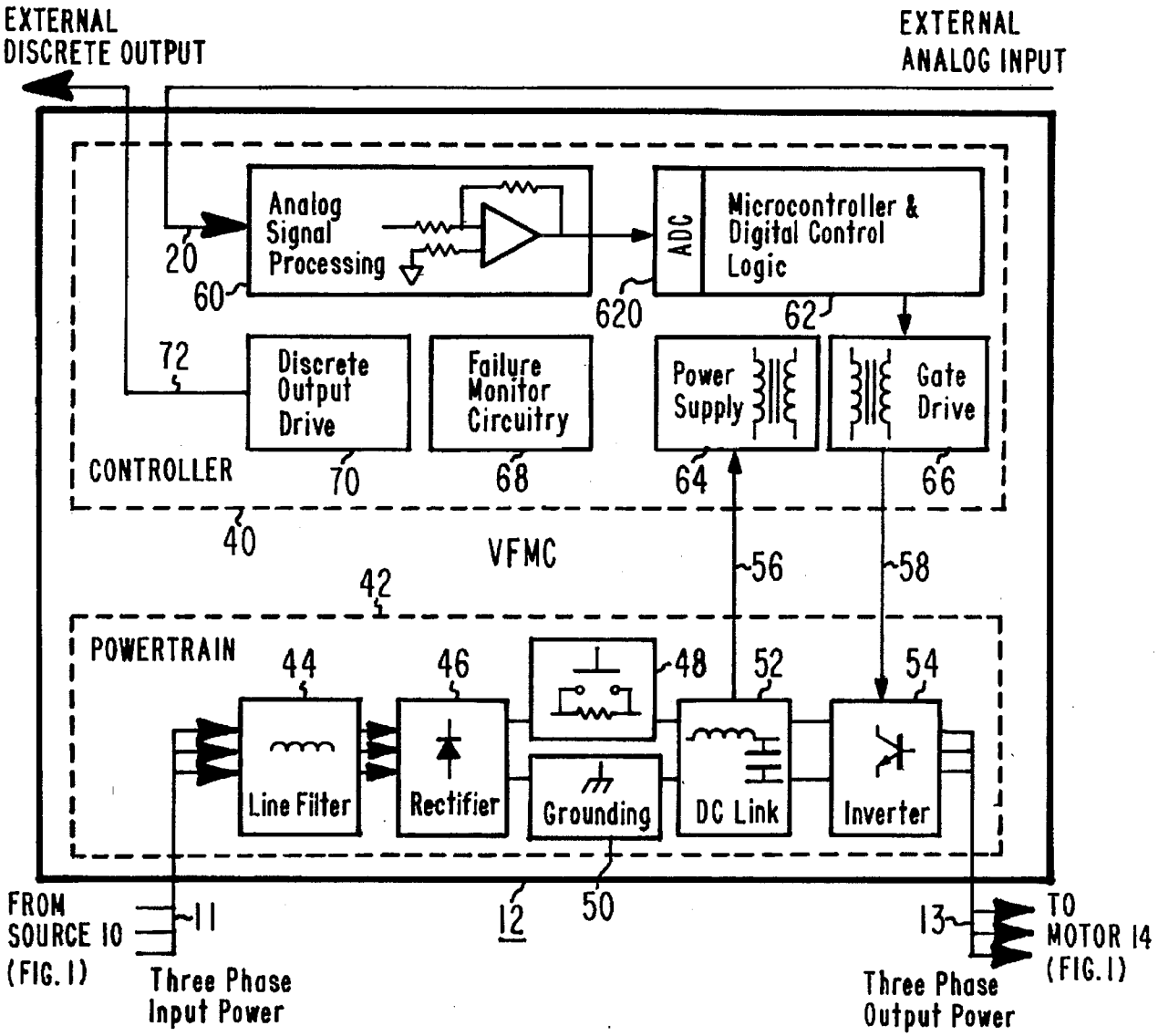
FIG. 2 is a functional block diagram of the system of FIG. 1, including a variable-frequency motor controller.

FIG. 2 illustrates details of motor controller 12 of FIG. 1. In FIG. 2, motor controller 12 can be seen to include a signal-processing controller portion 40 and a powertrain portion 42. The three-phase input power is applied from paths 11 to a block 44, representing a line filter, in powertrain 42. The filtered 3Φ AC power is applied to a three-phase rectifier arrangement illustrated as a block 46, which rectifies the power to produce pulsating direct current. The pulsating direct current from rectifier block 46 is coupled by way of blocks 48 and 50 to a filter arrangement 52, which filters the current to produce a direct voltage, also known as direct current (DC) voltage. Block 48 represents a current-limiting resistor, which controls or reduces electrical transients at start-up or power-up of motor controller 12, and which is shorted out of the circuit by a contactor or relay immediately after start-up. Block 50 represents a grounding arrangement, which in one embodiment of the invention includes grounding bleed resistors coupled between the DC rails and ground, to thereby refer the DC bus voltages positively and negatively to ground in proportion to the resistor values, where the resistors have equal values, and the bus voltages are therefore symmetric relative to chassis ground. Such symmetry may be advantageous in the reduction of electromagnetic interference effects. The direct voltage generated by filter 52 in response to the pulsating direct current input is the source of energizing power for a controllable three-phase DC-to-AC inverter illustrated as a block 54. In a particular embodiment of the invention, the inverter uses Isolated Bipolar Gate Transistors (IGBTs) as the power switching elements. The resulting inverted AC power is applied over path 13 to motor 14 of FIG. 1.

Signal controller 40 of FIG. 2 includes an analog signal processor illustrated as a block 60, the input port of which is coupled to feedback path 20 for receiving pressure signals from pressure sensor 18 of FIG. 1. Analog processor 60 performs the normal amplification or normalization, and such integration or other filtering as may be required. The processed analog signal at the output of analog processor 60 is converted to digital form in an analog-to-digital converter **62*a*, and the resulting digital signals are applied to a microprocessor 62 for producing control signals which ultimately control the frequency and amplitude of the power applied to motor 14 of FIG. 1. The control signals are applied from microprocessor 62 to a gate drive circuit illustrated as a block 66. Since the microprocessor produces logic high and logic low signals, it may directly generate the logic high and logic low signals at times which are appropriate for control of the control electrodes of the active power controllers of inverter 54. For example, microprocessor 62 may directly generate the logic high and logic low gate drive voltages, in which case gate drive circuit 66** might include as little as a simple isolation transformer, and the circuitry required to translate the logic voltages into the voltage levels necessary to drive the IGBTs.

The arrangement of FIG. 2 also includes a signal controller power supply illustrated as a block 64, which provides direct operating voltage for the various portions of signal controller 40, and which may also supply AC timing information to microprocessor 62 to enable it to directly control inverter 54. Also in signal controller block 40 are other blocks 68 and 70, not directly relevant to the invention. Block 68 monitors bus current, bus voltage, inverter temperature, and external inputs, to verify that the unit is capable of continuing safe operation. Block 70 drives discrete outputs which indicate system status and condition, as by illuminating a lamp on a cockpit panel.

Figure 3A:
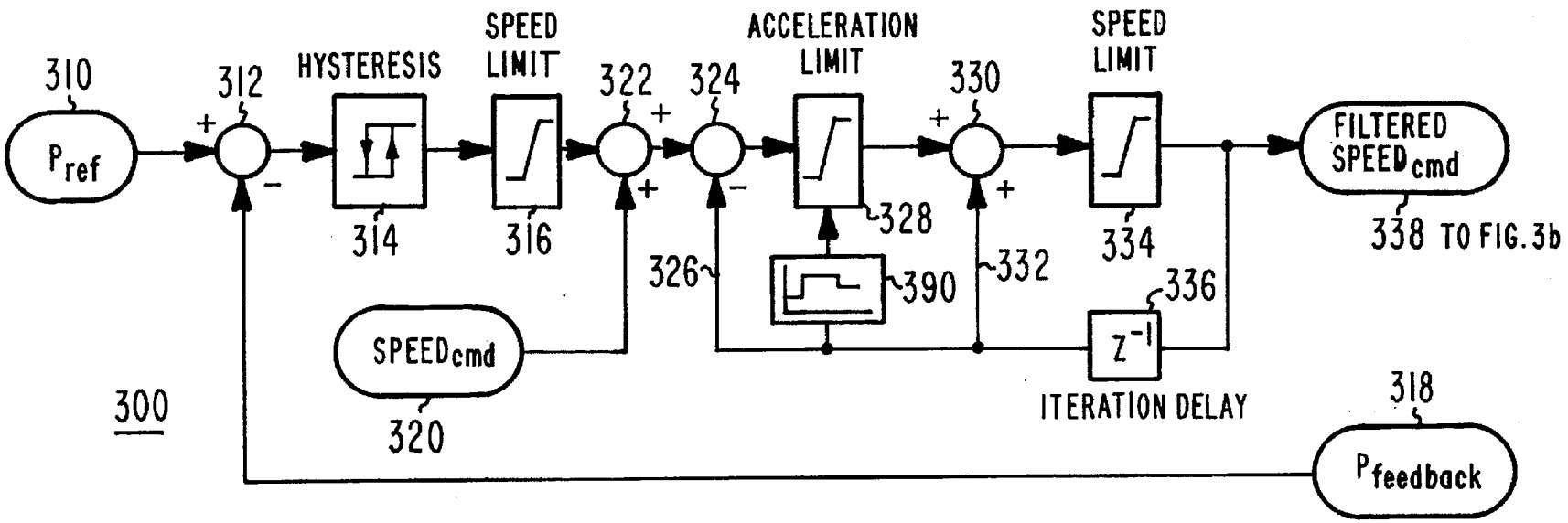
FIGS. 3*a* and 3*b* together represent a simplified block diagram of hardware which implements the functions of the motor controller of FIG. 2.

FIG. **3*a* is a simplified block diagram which illustrates the power-on-demand processing performed in signal controller block 62 of FIG. 2. In FIG. 3*a*, the pressure feedback signal from a block 318 is applied to the inverting (−) input port of a summing circuit 312, in which the feedback signal is subtracted from a reference signal representing a reference pressure from a source 310. The output of summing circuit 312 is a pressure error signal, which represents the hydraulic load experienced by the hydraulic system. The pressure error signal is applied to a hysteresis circuit or function 314 to enhance system steady-state stability by inhibiting loop response to noise and minor pressure fluctuations. The pressure error signal is applied from block 314 to a limiting circuit or function illustrated as a block 316, for limiting the maximum value of the pressure error signal which can be applied to the remainder of the system, for limiting the maximum value of the commanded motor speed as the control loop responds to a lowered pressure feedback signal. The limited pressure error signal is applied from limiting block 316 to an adder 322, in which it is added to a reference speed command signal from a source 320. The reference speed command establishes a fixed "minimum" speed toward which the controller drives the motor in the absence of any pressure error signal. The pressure-modified speed command signal is applied from summing circuit 322 to the noninverting input port (+) of a further summing circuit 324, in which a delayed sample of the current filtered speed signal is subtracted, to produce a further error signal. The delayed signal which is subtracted from the speed signal in block 324 is related to acceleration, because of the delay imparted by the iteration delay 336, so the speed signal produced by summing circuit 324 is corrected by acceleration. The speed error signal is applied from summing circuit 324 to an acceleration-limiting circuit or function 328, which limits the maximum value of the error signal from summer 324. The limited signal from limiting block 328 is applied to a further summing circuit or function 330, in which it is summed with the delayed filtered speed signal, to produce a further speed command signal, which is limited in a block 334 to produce the desired filtered speed signal at output block 338**. This signal is in the form of a digital signal which is updated at every clock cycle.

Figure 3B:
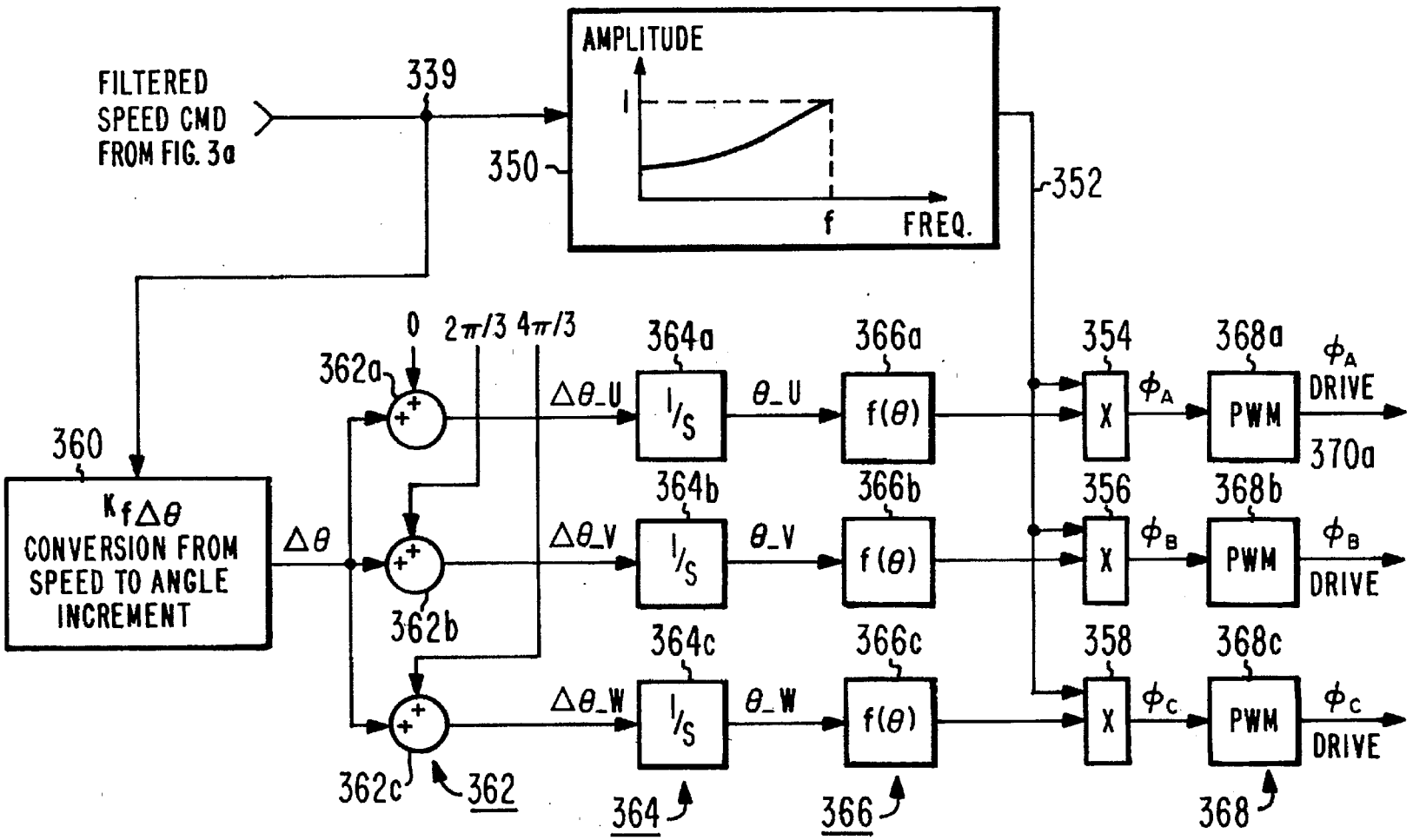

FIG. **3*b* is a simplified block diagram of hardware which receives the filtered speed signal from FIG. 3*a*, and which converts the speed signals into drive signals for the switching elements of inverter 54 of FIG. 2. In FIG. 3*b*, the filtered speed signal arrives at a signal path 339 from block 338 of FIG. 3*a*, and is applied to an amplitude/frequency conversion block 350 and to a coefficient multiplication block 360. Amplitude/frequency conversion block 350 generates an amplitude multiplier signal on a signal path 362, which depends upon the frequency of the drive signal. The amplitude multiplier signal is applied over a signal path 352 to one input port of each multiplier of a set of multipliers 354, 356, and 358, in which they are used as multipliers for the sinusoidal motor drive signals applied to the other input ports of the set of multipliers, to generate digital signals representative of a sinusoidal signal, as described below. Thus, the amplitude of the motor drive signals is a function of the motor drive frequency. As suggested by the plot within block 350, the amplitude function produced by the block is close to a direct function of frequency (Kf) for all frequencies below the motor rated operating speed, with a slight additional amplitude offset near zero frequency, which provides greater drive amplitude when the motor is starting, in order to help overcome frictional forces. The rated motor operating frequency is indicated as "f" in the plot of block 350, and corresponds, in one embodiment of the invention, to 400 Hz., which is the frequency for which conventional motors for aircraft use are designed. This allows use with the invention of conventional aircraft-type three-phase induction motors. Thus, when the motor drive frequency is equal to the motor design frequency, the amplitude multiplier produced by block 350** is unity, as a result of which the motor is driven at its full rated voltage at the rated frequency.

The filtered speed signals applied from block 338 of FIG. 3*a* to coefficient multiplier block 360 of FIG. 3*b* are multiplied by a coefficient $K_{f\,\Delta\theta}$, to produce sine step signals ($\Delta\theta$). Block 360 represents a conversion between speed and angle, either in degrees or radians. The value of $K_{f\,\Delta\theta}$ is a constant, because the conversion is made at the iteration rate of the processor, which is fixed. In the fixed conversion incremental time, a higher commanded frequency results in a greater value of incremental phase. Thus, block 360 converts the speed command into a time function sine step signal $\Delta\theta$. The sine step signal is applied to a first input port of each of three summing circuits 362*a*, 362*b*, and 362*c*, designated jointly as 362, which add the sine step signal to 0, $2\pi/3$, and $4\pi/3$, respectively, to provide $\Delta\theta$_u, $\Delta\theta$_v, and $\Delta\theta$_w signals which are at relative 0°, 120°, and 240° phases. Thus, the arrangement of summing circuits 362 converts the single sine step signals into three-phase signals.

The $\Delta\theta$_u, $\Delta\theta$_v, and $\Delta\theta$_w signals from summing circuits 362*a*, 362*b*, and 362*c*, respectively, of FIG. 3*b*, are applied to corresponding integrator (1/s) blocks 364*a*, 364*b*, 364*c*, referred to jointly as integrators 364. Each integrator integrates the signal applied thereto, to convert the signals $\Delta\theta$_u, $\Delta\theta$_v, and $\Delta\theta$_w applied thereto into cumulative angle signals $\theta$_u, $\theta$_v, and $\theta$_w, respectively. The cumulative angle signals $\theta$_u, $\theta$_v, and $\theta$_w are together known as $\theta$ signals. Each integrator adds the current increment input signal with its current sum, to form the new sum value, and continues this process until the sum value reaches $\pi$, at which time its sum is reset to zero, and a new sum is started. Thus, each integrator 364*a*, 364*b*, and 364*c* produces $\theta$ signals which recurrently range from zero to $\pi$ in response to the filtered speed signal, with the speed at which the $\theta$ signals increment being controlled by the commanded speed.

Figure 4A:
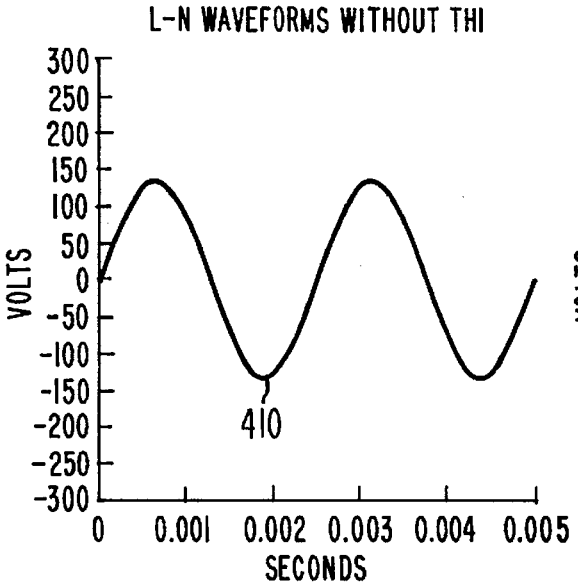
FIG. 4*a* is an amplitude-time plot of a simple sinusoidal function representing the line-to-neutral voltage of a three-phase drive.
Figure 4B:
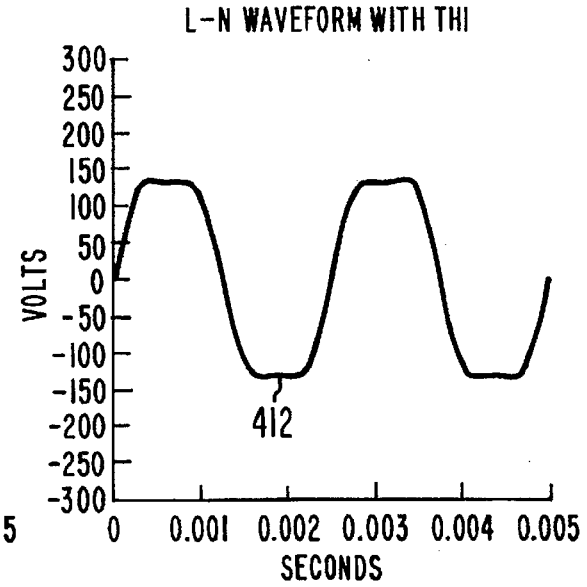
FIG. 4*b* is a corresponding plot of a the same sinusoidal function combined with an additional third-harmonic component.

The cumulative angle signals $\theta$_u, $\theta$_v, and $\theta$_w produced by integrator blocks 364*a*, 364*b*, 364*c*, respectively, are applied to corresponding memories 366*a*, 366*b*, and 366*c*, respectively, referred to jointly as memories 366. Each memory 366*a*, 366*b*, and 366*c* uses the cumulative angle signal applied to its input to address a word of the memory. The memory locations are accessed in order, in response to the current value of $\theta$. Each of the three memories 366 is preprogrammed with the same values at corresponding addresses. The values of the preprogrammed words in memories 366 do not correspond simply to a sinusoidal function such as half a sine wave, but instead to half a sine wave modified by addition of a third-harmonic component of the fundamental sine wave. This modification is referred to as "third harmonic injection" (THI). FIG. 4*a* is an amplitude-time (voltage-versus-seconds) plot which illustrates a pure sine wave 410 at a fundamental frequency of about 400 Hz., while FIG. 4*b* illustrates as a plot 412 the same fundamental sine wave with the addition of an in-phase third harmonic component, which tends to flatten the peaks of the fundamental component. Each memory 366*a*, 366*b*, and 366*c* is preprogrammed with either the positive or negative half-cycle of the sine wave of FIG. 4*b*. It should be noted that the three distinct phases are separated in summing circuits 362 of FIG. 3*b*, so the programming of the memories 366 may be identical (same word at same address).

The digital words from memories 366*a*, 366*b*, and 366*c* are sequentially applied to the second input ports of multipliers 354, 356, and 358, respectively, for multiplication by the then-current value of the amplitude multiplier signal from block 350, to produce the three phase sequence signals $\phi_A$, $\phi_B$, and $\phi_C$, respectively. The multiplied digital words of phase sequence signals $\phi_A$, $\phi_B$, and $\phi_C$, each of which, taken together in sequence, represents a half-cycle of fundamental-plus-third-harmonic, are applied from multipliers 354, 356, and 358 to pulse-width modulators 368*a*, 368*b*, and 368*c*, respectively, which are referred to jointly as 368. Pulse-width modulators 368*a*, 368*b*, and 368*c* convert the current word of the phase sequence signals $\phi_A$, $\phi_B$, and $\phi_C$ into relative pulse widths having an ON-OFF ratio which corresponds to the relative amplitude represented by that current word of the phase sequence signal. When the pulse-width modulated signal is applied to the control electrode of the corresponding one of the power control transistors of the inverter, the DC bus voltage is applied to the induction motor in a relative magnitude established by the word.

Figure 5A:
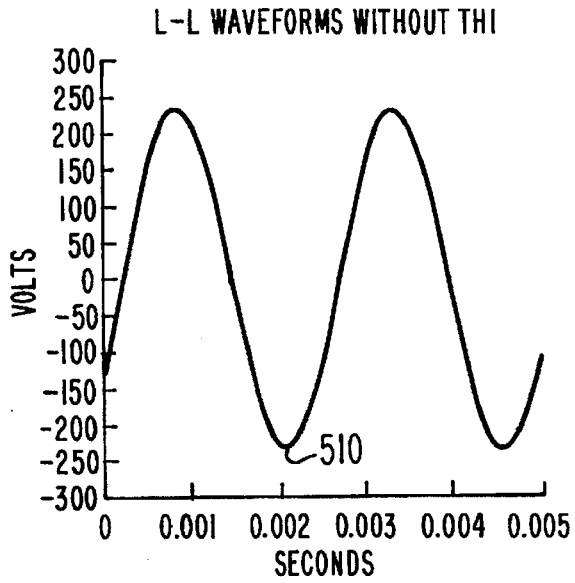
FIG. 5*a* is an amplitude-time plot of a simple sinusoidal function representing the line-to-line voltage of a three-phase drive.
Figure 5B:
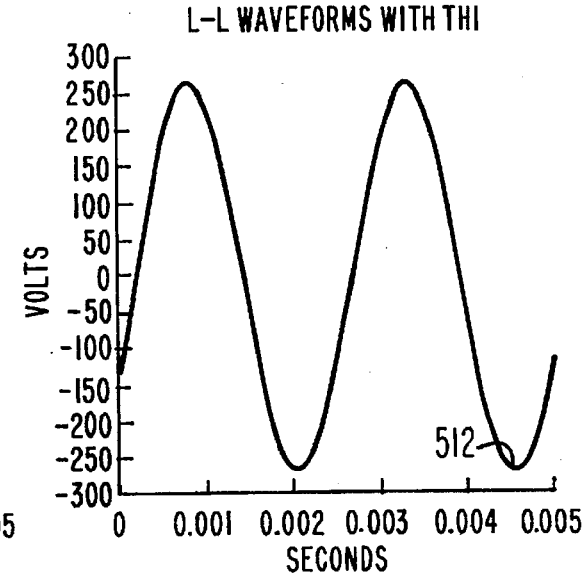
FIG. 5*b* is a corresponding plot of the same sinusoidal function combined with the additional third-harmonic component

The addition of the in-phase third-harmonic component to the fundamental as described in conjunction with the discussion of memories 366 of FIG. 3*b* results in application to the motor windings of voltages greater than the available direct voltage of the energizing bus. Plot 510 of FIG. 5*a* represents the line-to-line (L—L) waveforms resulting from the L–N voltage 410 of FIG. 4*a*, which has a maximum value of about 220 volts. The corresponding L—L voltage resulting from the fundamental-plus-third-harmonic L–N voltage 412 of FIG. 4*b* is illustrated as 512 in FIG. 5*b*. As illustrated, the peak voltage is greater than 250 volts, which is considerably more than that available without third harmonic injection.

Figure 6:
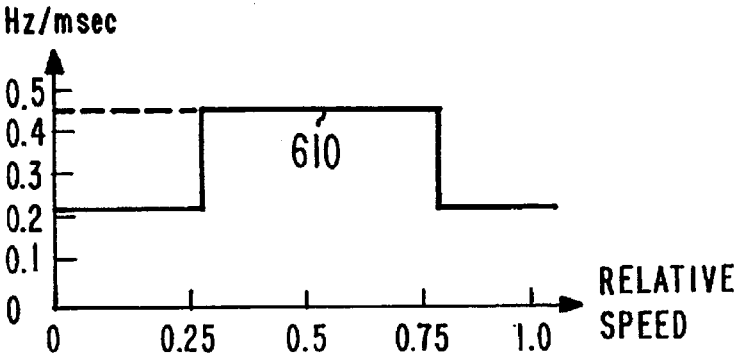
FIG. 6 is a plot of the acceleration schedule.

Induction motors typically draw very high inrush currents at start-up. These inrush currents may be as high as eight times the steady-state draw. A conventional motor, for this reason, may require wiring which is heavier than that required for the steady-state condition, and the circuit breakers may have to be rated for such a high current, to handle the inrush, that they provide little actual protection for faults which may occur at times other than start-up. A soft-start characteristic is imparted to the system by the controller of FIG. 3*a*. More particularly, a block 390 of FIG. 3*a*, connected between the output of delay block 336 and acceleration limit block 328, provides an acceleration schedule at start-up which limits the inrush current. FIG. 6 plots the acceleration schedule which is imparted by block 390 to limiter block 328. In FIG. 6, plot 610 has a constant acceleration value of 0.219 Hz./msec. from a motor-stopped condition up to ¼ speed. Between ¼ speed and ¾ speed, the acceleration is 0.438 Hz./msec. At motor speeds between ¾ and full speed, the acceleration reverts to 0.219 Hz./msec. The negative acceleration is a constant value of 0.0219 Hz./msec.

The above-described "power-on-demand" control system provides a significant electrical power saving, with very moderate compromise of the hydraulic system performance. More particularly, in a test using a hydraulic system having a typical operating condition of one gallon-per-minute (GPM) at 3000 PSI, driving the motor at half speed halves the electrical power drain from about 10 KVA to about 5 KVA, but the hydraulic pressure drops only about 2%, from 3150 to 3080 PSI. The KVA reduction comes about not only from the reduced motor speed, but also from improved power factor. The improved power factor comes about because the highly inductive motor windings are not connected directly to the three-phase AC source, but are instead connected by way of the motor controller, which has a much higher power factor. Consequently, the source does not need to supply so much current in order to provide the power demanded.

The soft-start arrangement according to the invention, when operating with a pump pressure of about 3000 PSI and a load of 3 GPM, resulted in maintaining maximum motor currents very near the motor rating for the steady-state condition, which corresponds to as much as an eight-to-one reduction in inrush current.

Other embodiments of the invention will be apparent to those skilled in the art. For example, while block 50 of FIG. 2 has been described as using resistors to symmetrically dispose the positive and negative DC buses relative to ground, the disposition may be non-symmetric if desired, and in either case, nonlinear voltage regulators such as Zener or avalanche diodes may be used in place of a resistor, to clamp the associated bus to a fixed voltage relative to ground, all as known in the art. If the frequency function memory blocks 366 of FIG. 3*b* produce signals, the peak value of which represents less (more) than the full rated voltage drive to the gates of the inverters, the amplitude multiplication function of block 350 may produce a multiplier having a peak amplitude of greater (less) than unity. A pressure-sensitive switch with built-in hysteresis can be substituted for the pressure sensor and analog pressure feedback signal. As a further alternative, an indicator of applied load other than system hydraulic pressure may be used to implement the "power-on-demand" control according to the invention. Two such indications of measures of applied load are the DC voltage droop at the inverter or system current demand;

What is claimed is:

1. A system for driving a hydraulic pump from a source of multiphase alternating current, said system comprising:

a hydraulic pump including mechanical drive means, which produces hydraulic pressure for application to a hydraulic load which may vary;

pressure sensing means coupled to said hydraulic pump, for producing pressure signals representative of said hydraulic pressure;

a multiphase alternating-current induction motor mechanically coupled to said mechanical drive means of said hydraulic pump, and including at least a plurality of windings associated with a predetermined number of poles, each winding being driven by a different phase of said alternating current, for driving said pump in response to electrical power applied to said plurality of windings;

rectifying means adapted to be coupled to said source of multiphase alternating current, for generating direct voltage;

controllable multiphase inverter means coupled to said rectifying means and to said plurality of windings of said motor, for converting said direct voltage into multiphase alternating voltages of controllable amplitude and frequency applied to said windings of said motor;

error signal generating means coupled to said pressure sensing means and to a source of signals representing a reference pressure, for generating a difference signal indicative of the load applied to the pump and of the pressure error;

motor speed signal generating means coupled to said error signal generating means, for converting said pressure error signal into signals representative of a desired motor speed for the current load condition;

inverter gate drive means coupled to said motor speed signal generating means and to said inverter means, for converting said motor speed signal into alternating drive signals for said windings of said motor, said drive signals having a fundamental frequency and amplitude, said fundamental frequency being equal to said desired motor speed multiplied by a quantity, which quantity is equal to one-half the number of said poles of said motor, said amplitude being normalized by the ratio of said fundamental frequency to a reference frequency, said alternating drive signals including a component at the third harmonic of said fundamental frequency.

2. A system according to claim 1, wherein said inverter gate drive means generates said motor drive signals with said amplitude, the value of which is normalized by the ratio of said fundamental frequency to said reference frequency at maximum frequency, and which has a finite value at zero frequency, and which comprises components of said finite value and said normalized value at frequencies between zero and maximum.

3. A system according to claim 1, wherein said motor speed signal generating means comprises:

a source of signals representing a minimum motor speed;

summing means including a first input port coupled to said source of signals representing a minimum motor speed, and a second input port, for summing said signals representing minimum motor speed with signals applied to said second input port of said summing means of said motor speed signal generating means;

pressure signal limiting means coupled to said second input port of said summing means of said motor speed signal generating means and to said pressure error signal generating means, for limiting a peak value of said pressure error signal, and for coupling a limited pressure error signal to said second input port of said summing means of said motor speed signal generating means, whereby said summing means of said motor speed signal generating means generates said signals representative of the desired motor speed which corresponds to the current load condition.

4. A system according to claim 1, wherein said inverter gate drive means comprises:

first summing means including a first input port coupled to said motor speed signal generating means, and also including a second input port, for summing said motor speed signal with a signal applied to said second input port of said first summing means, to thereby generate a processed motor speed signal;

delay means coupled to an output of said inverter gate drive means and to said second input port of said first summing means of said inverter gate drive means, for delaying said alternating drive signals for said windings of said motor to form delayed alternating drive signals, and for coupling said delayed alternating drive signals to said second input port of said first summing means of said inverter gate drive means;

controllable limiting means coupled to the output of said first summing means of said inverter gate drive means, said controllable limiting means including a limit control signal input port, for limiting said processed motor speed signal in accordance with a limit value established by said limit control signal to generate a limited processed speed signal;

a source of limit control signal coupled to said limit control signal input port of said controllable limiting means;

second summing means including a first input port coupled to said controllable limiting means and a second input port coupled to the output of said delay means, for summing said limited processed speed signal with said delayed alternating drive signals to generate unlimited filtered speed signal;

second limiting means coupled to said second summing means, for limiting the value of said unlimited filtered speed signal to less than a predetermined value, to thereby generate said filtered speed signals.

5. A system according to claim 4, wherein said source of limit control signal comprises memory means coupled to said limit control signal input port of said controllable limiting means and to said delay means, for comparing a value of said filtered speed signal with first and second finite values of said filtered speed signal, and for commanding a first limit when said filtered speed signal lies below said first finite value and when said filtered speed signal lies above said second finite value, and for commanding a second limit, greater than said first limit, when said filtered speed signal lies between said first and second finite values.

6. A system for driving a mechanical energy converter from a source of multiphase alternating current, said system comprising:

a mechanical energy converter including mechanical drive means, which produces a mechanical drive for application to a load which may vary under some load condition;

drive characteristic sensing means coupled to said mechanical energy converter, for producing characteristic signals representative of said mechanical drive;

a multiphase alternating-current induction motor mechanically coupled to said mechanical drive means of said mechanical energy converter, and including at least a plurality of windings associated with a predetermined number of poles, each winding being driven by a different phase of said alternating current, for driving said mechanical energy converter in response to electrical power applied to said plurality of windings;

rectifying means adapted to be coupled to said source of multiphase alternating current, for generating direct voltage;

controllable multiphase inverter means coupled to said rectifying means and to said plurality of windings of said motor, for converting said direct voltage into multiphase alternating voltages of controllable amplitude and frequency applied to said windings of said motor;

error signal generating means coupled to said characteristic sensing means and to a source of signals representing a reference characteristic, for generating a difference signal indicative of a characteristic error;

motor speed signal generating means coupled to said error signal generating means, for converting said characteristic error representative difference signal into motor speed signals representative of a desired motor speed which corresponds to the current load condition;

motor drive means coupled to said motor speed signal generating means and to said inverter means, for converting said motor speed signal into alternating drive signals for said windings of said motor, said drive signals having a fundamental frequency and amplitude, said fundamental frequency being equal to said desired motor speed multiplied by a quantity, which quantity is equal to one-half the number of said poles of said motor, said amplitude being normalized by the ratio of said fundamental frequency to a reference frequency, said alternating drive signals at said fundamental frequency including a component at the third harmonic of said fundamental frequency.

* * * * *